US006142617A

United States Patent [19]

Barinaga et al.

[11] Patent Number: 6,142,617

[45] Date of Patent: Nov. 7, 2000

[54] INK CONTAINER CONFIGURED FOR USE WITH COMPACT SUPPLY STATION

[75] Inventors: John A. Barinaga, Portland; Bruce Cowger, Corvallis; James E. Clark, Albany, all of Oreg.; John A. Underwood, Vancouver, Wash.; Paul David Gast, Barcelona, Spain; Susan M. Hmelar, Corvallis, Oreg.

[73] Assignee: Hewlett-Packard Company, Palo Alto, Calif.

[21] Appl. No.: 08/789,957

[22] Filed: Jan. 30, 1997

Related U.S. Application Data

[63] Continuation-in-part of application No. 08/706,061, Aug. 30, 1996, abandoned, which is a continuation-in-part of application No. 08/566,641, Dec. 4, 1995, Pat. No. 5,721,576, which is a continuation-in-part of application No. 08/429,915, Apr. 27, 1995, Pat. No. 5,825,387.

[51] Int. Cl.[7] ..... B41J 2/175

[52] U.S. Cl. ..... 347/85

[58] Field of Search ..... 347/86, 50, 85, 347/49

[56] References Cited

U.S. PATENT DOCUMENTS

| | | | |
|---|---|---|---|
| 4,162,501 | 7/1979 | Mitchell et al. | 347/86 |
| 4,183,031 | 1/1980 | Kyser et al. | 347/86 |
| 4,253,103 | 2/1981 | Keinzl et al. | 347/86 |
| 4,475,116 | 10/1984 | Sicking et al. | 347/86 |
| 4,511,906 | 4/1985 | Hara | 347/86 |
| 4,568,954 | 2/1986 | Rosback | 347/86 |
| 4,633,274 | 12/1986 | Matsuda | 347/50 |
| 4,737,801 | 4/1988 | Ichihashi et al. | 347/85 |
| 4,760,409 | 7/1988 | Kiyohara et al. | 347/86 |
| 4,811,035 | 3/1989 | Huliba et al. | 347/89 |
| 4,831,389 | 5/1989 | Chan | 347/86 |
| 4,888,602 | 12/1989 | Watanabe et al. | 346/134 |
| 4,968,998 | 11/1990 | Allen | 347/7 |
| 5,049,898 | 9/1991 | Arthur et al. | 347/19 |
| 5,221,935 | 6/1993 | Uzita | 347/36 |
| 5,245,361 | 9/1993 | Kashimura et al. | 347/50 |
| 5,307,091 | 4/1994 | DeCoste, Jr. | 347/86 |
| 5,359,357 | 10/1994 | Takagi et al. | 347/49 |
| 5,367,328 | 11/1994 | Erickson | 347/7 |
| 5,369,429 | 11/1994 | Erickson | 347/7 |
| 5,488,401 | 1/1996 | Mochizuki et al. | 347/86 |
| 5,504,512 | 4/1996 | Shimoda et al. | 347/86 |
| 5,506,611 | 4/1996 | Ujita et al. | 347/86 |
| 5,512,925 | 4/1996 | Ohashi | 347/86 |
| 5,512,926 | 4/1996 | Uchikata et al. | 347/86 |
| 5,721,576 | 2/1998 | Barinaga | 347/85 |
| 5,784,087 | 7/1998 | Wallace et al. | 347/85 |
| 5,825,387 | 10/1998 | Cowger et al. | 347/86 |

*Primary Examiner*—N. Le
*Assistant Examiner*—Michael Nghiem
*Attorney, Agent, or Firm*—Kevin B. Sullivan

[57] ABSTRACT

The present invention is a replaceable ink container for use in a printing system. The printing system is of the type having a printhead mounted in a scanning carriage and a supply station for receiving the replaceable ink container. The supply station is in fluid communication with the printhead. The replaceable ink container includes a fluid outlet configured for engaging corresponding fluid inlet portions on the supply station. Also included is a first and second guide feature disposed on an outer surface of the replaceable ink container. The first and second guide features are disposed and arranged to engage corresponding first and second guiding features disposed on opposite ends of the supply station to guide the replaceable ink container into the supply station to fluidically couple the fluid outlet and corresponding fluid inlet.

15 Claims, 7 Drawing Sheets

SECTION A-A'

INK CONTAINER CONFIGURED FOR USE WITH COMPACT SUPPLY STATION

CROSS-REFERENCE TO RELATED APPLICATIONS

This application is a continuation-in-part of U.S. patent application Ser. No. 08/706,061, abandoned, filed Aug. 30, 1996, entitled "Ink-Jet Printing System With Off-axis Ink Supply And High Performance Tubing", now abandoned, a continuation-in-part of U.S. patent application Ser. No. 08/429,915 filed Apr. 27, 1995, entitled "Ink Supply For An Ink-Jet Printer", now U.S. Pat. No. 5,825,387, and a continuation-in-part of U.S. patent application Ser. No. 08/566,641 filed Dec. 4, 1995, entitled "Refill Kit And Method For Refilling An Ink Supply For An Ink-Jet Printer", now U.S. Pat. No. 5,721,576, both of which are incorporated herein by reference and are related to commonly assigned applications filed herewith entitled "Ink Container Configured For Use With Printer", Ser. No. 08/789,959, filed Jan. 30, 1997, and patent application entitled "Electrical And Fluidic Interface For An Ink Supply", Ser. No. 08/791,290, filed Jan. 30, 1997, and patent application entitled "Electrical Interconnect For Replaceable Ink Containers, Ser. No. 08/789,958, filed Jan. 30, 1997, the entire contents of which are incorporated by reference herein.

BACKGROUND OF THE INVENTION

The present invention relates to replaceable ink containers for providing ink to an ink-jet printhead. More specifically, the present invention relates to ink containers that are configured for use with printers to allow a printer layout having efficient use of space, accessible ink containers, and a reduced printer footprint.

Ink-jet printers frequently make use of an ink-jet printhead mounted to a carriage which is moved back and fourth across a print media, such as paper. As the printhead is moved across the print media, a control system activates the printhead to eject or jet ink droplets onto the print media to form images and text.

Previously used printers have made use of an ink container that is separably replaceable from the printhead. When the ink container is exhausted the ink container is removed and replaced with a new ink container. The use of replaceable ink containers that are separate from the printhead allow users to replace the ink container without replacing the printhead. The printhead is then replaced at or near the end of printhead life and not when the ink container is exhausted.

There is an ever present need for printing systems that are small, reliable, and configured with ergonomics of the user in mind. Routine servicing such as replacing ink containers should be easily accomplished by the vast majority of printer users. In the case of color printing often four or more inks are used. For example, CYMK color printing makes use of cyan, yellow, magenta and black inks. Printers which make use of replaceable ink containers for each ink color must position these containers where they are readily accessible and readily graspable by the user for ease of replacement. Furthermore, these printers should be relatively small in both printer height and printer area to help minimize use of counter or desk space as well as maximize the flexibility of printer placement for the user.

SUMMARY OF THE INVENTION

The present invention is a replaceable ink container for use in a printing system. The printing system is of the type having a printhead mounted in a scanning carriage and a supply station for receiving the replaceable ink container. The supply station is in fluid communication with the printhead. The replaceable ink container includes a fluid outlet configured for engaging corresponding fluid inlet portions on the supply station. Also included is a first and second guide feature disposed on an outer surface of the replaceable ink container. The first and second guide features are disposed and arranged to engage corresponding first and second guiding features disposed on opposite ends of the supply station to guide the replaceable ink container into the supply station to fluidically couple the fluid outlet and corresponding fluid inlet.

DETAILED DESCRIPTION OF THE PREFERRED EMBODIMENT

Figure 1:
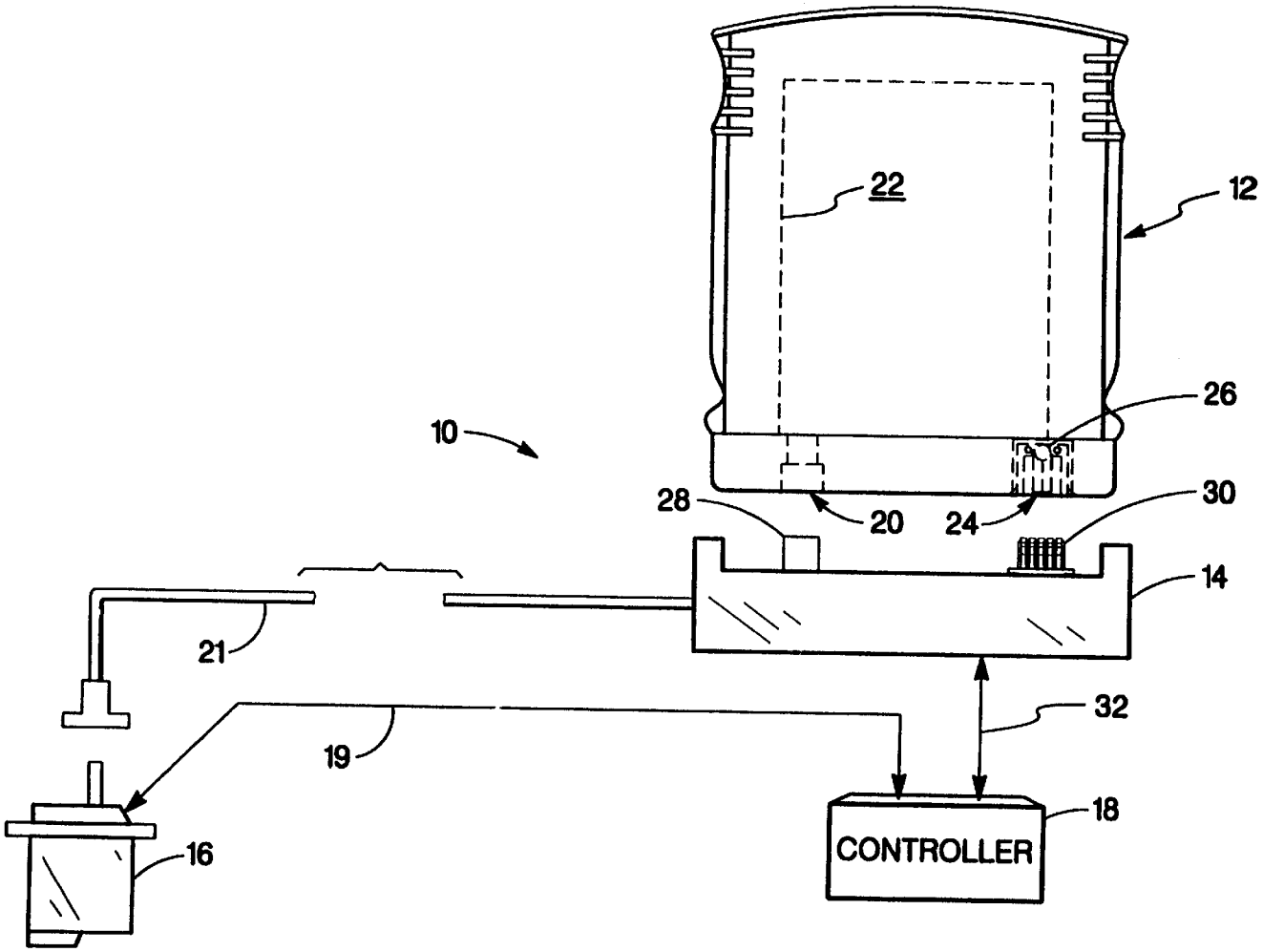
FIG. 1 shows a schematic representation of the printing system showing an ink container of the present invention which forms a fluid interconnect and an electrical interconnect with the printing system.

FIG. 1 is a schematic representation which depicts an ink-jet printer 10 that includes an ink container 12 of the present invention. The ink-jet printer 10 also includes an ink container receiving station or supply station 14, an ink-jet printhead 16 and a print controller 18. Printing is accomplished by the printer 10 by the ejection of ink from the printhead 16 under the control of print controller 18. The printhead 16 is connected to the controller 18 by a link 19 for controlling ejection of ink. Ink is provided to the printhead 16 by way of a fluid conduit 21 which fluidically connects the printhead 16 to the ink container receiving station 14. The ink container 12 includes an ink outlet 20 which is in fluid communication with a fluid reservoir 22. In one preferred embodiment the ink container 12 includes a plurality of electrical contacts 24 which are electrically connected to an information storage device 26.

The ink outlet 20 and the electrical contacts 24 allow the ink container 12 to reliably interconnect with a fluid inlet 28 and electrical contacts 30, respectively, associated with the ink container receiving station 14. The ink container receiving station 14 enables ink to be transferred from the fluid reservoir 22 associated with the ink container 12 to the printhead 16 via the fluid conduit 21. After providing ink to the printhead 16, the ink container 12 can be refilled. In addition, the ink container receiving station 14 allows the transfer of information between the information storage device 26 associated with the ink container 12 and the print controller 18 via a link 32.

Figure 2:
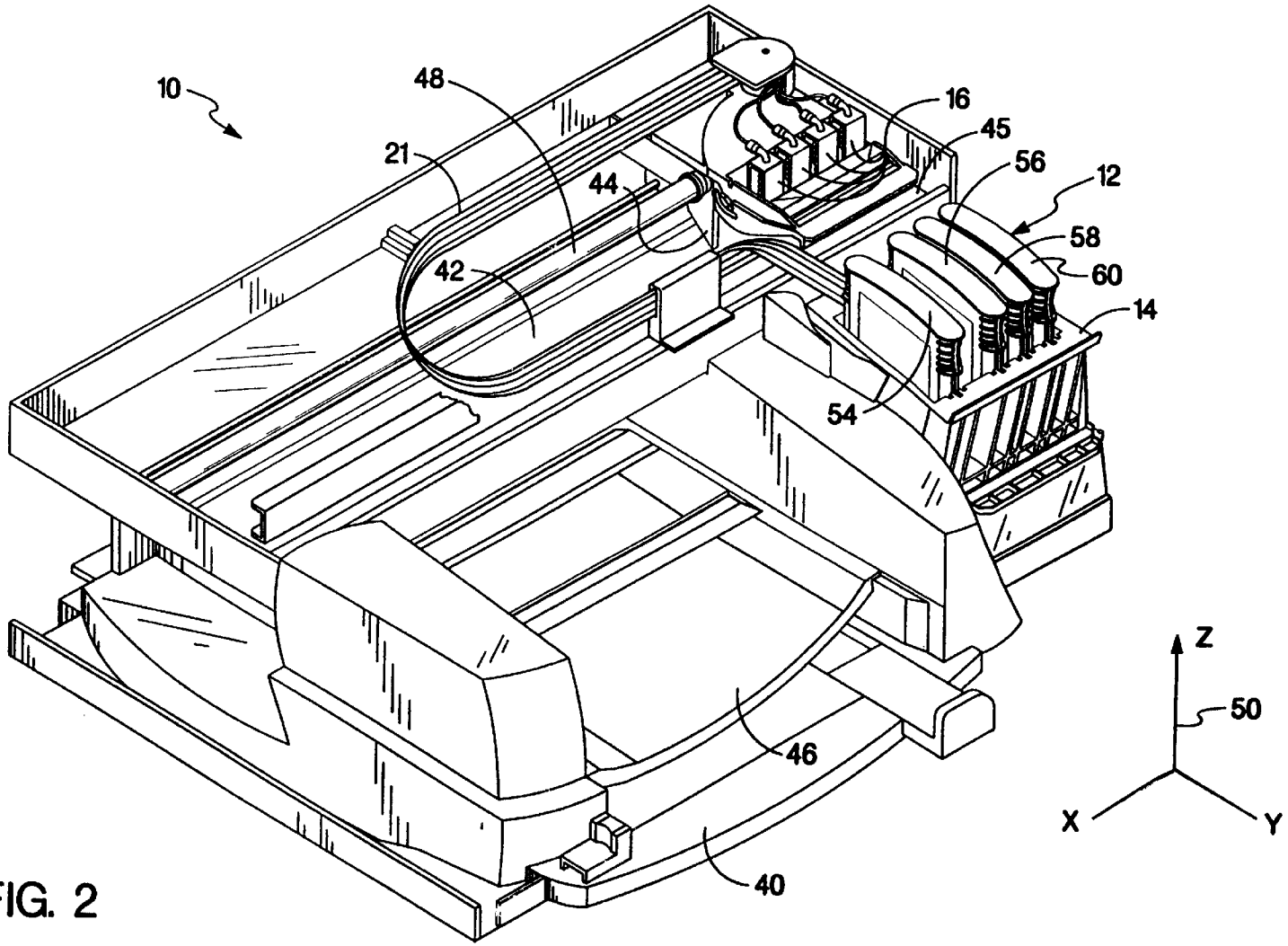
FIG. 2 is a perspective view of a printer with cover removed, which incorporates the ink container of the present invention.

FIG. 2 depicts a perspective view of one embodiment of the ink jet printer 10, with its cover removed, containing one or more ink containers 12. The present invention is directed to a method and apparatus for guiding the ink containers 12 into the ink-jet printer 10 to ensure that a reliable fluidic, electrical and mechanical engagement is achieved between the ink container and the printer 10. More specifically, the present invention relates to guiding features provided on both the ink container 12 and the printer 10 which allow for the positioning of the ink containers 12 in a compact manner thereby maintaining a small printer size and footprint or printer area.

The printer 10 includes a tray 40 for holding a paper supply. When a printing operation is initiated a sheet of paper from tray 40 is fed into printer 10 using a sheet feeder (not shown). During printing the paper passes through a print zone 42 whereupon a scanning carriage 44, containing one or more printheads 16, is scanned across the sheet for printing a swath of ink thereon. The sheet of paper is stepped through the print zone 42 as the scanning carriage 44 prints a series of swaths of ink to form images thereon.

After printing is complete, the sheet is positioned into an output tray 46, the positioning of the paper supply 40 and the output tray 46 can vary depending on the particular sheet feed or continuous feed mechanism used.

The scanning carriage 44 moves through the print zone 42 on a scanning mechanism which includes a slide rod 48 on which the scanning carriage 44 slides. A coordinate system 50 is depicted as having 3 mutually orthogonal axes, (x, y, z). The x axis has an orientation parallel to the direction of movement of the scanning carriage 44. The y axis has an orientation along a direction in which the print media is stepped through the print zone 42. A positioning means such as a coded strip (not shown) is used in conjunction with a photo detector in the scanning carriage 44 for precisely positioning the scanning carriage 44. A stepper motor (not shown), connected to the scanning carriage 44 using a conventional drive belt and pulley arrangement, is used for transporting the scanning carriage 44 across the print zone 42.

A ribbon cable (not shown) carries electrical signals to the scanning carriage 44 for selectively energizing the printheads 16. As the printheads 16 are selectively energized, ink of a selected color is ejected onto the print media as the scanning carriage 44 passes through the print zone 42.

The scanning carriage 44 in FIG. 2 is shown positioned at a non-printing portion or in a service station 45 disposed adjacent the print zone portion 42. The service station 45 maintains the printheads 16 to ensure optimum print quality over time. The service station 45 typically performs one or more of the following operations: a)printhead 16 priming, b)covering an orifice plate and other openings in the printhead 16 when the printhead 16 is not in use, c)wiping contaminants from the orifice plate, d)preventing ink from drying in openings within the orifice plate, e)providing a location to eject soft, viscous plugs of ink from drying out in the openings of the orifice plate. Service stations for ink-jet printers 10 are discussed in more detail in U.S. Pat. No. 5,300,958 to Burke et al. Entitled "Method and Apparatus for Automatically Cleaning the Printhead of a Thermal Inkjet Cartridge", assigned to the assignee of the present invention and incorporated herein by reference.

The present invention relates to the ink container 12 which provides ink to the printheads 16 for ejection onto print media. The ink container 12 is referred to as an off-axis ink supply because the ink supply is spaced from a scan axis which is defined by the scanning carriage 44. The scan axis is orientated along the x axis in coordinate system 50. This off-axis ink delivery system includes an ink container receiving station 14, for receiving the ink container 12. These ink containers 12, in the case of color printing, are often separate ink containers 12 for each color and an ink container 12 for black ink. For example, the ink container 12 for one preferred embodiment shown in FIG. 2 is a plurality of inks 54, 56, 58 and 60. The container 54 is for containing black ink, the ink container 56 is for yellow ink, the ink container 58 is for magenta ink, and the ink container 60 is for cyan ink. The receiving station 14 contains a mechanical interface, a fluid interface, and an electrical interface. The ink container 12 is inserted into the receiving station 14 along a z axis of the coordinate system 50 which is in a direction generally orthogonal to both the scan axis (x axis) and the direction in which media is stepped during advancement through the print zone (y axis). Once the ink container 12 is properly inserted and latched into place electrical, mechanical and fluidic interfacing is accomplished with the printer 10. Ink passes through these fluid interfaces in the receiving station 14 through a fluid conduit 21 such as tubing which fluidly connect the ink containers 54, 56, 58, and 60 with corresponding printheads 16 on the print scanning carriage 44.

In one preferred embodiment, the ink container 12 is positioned in an orientation that is approximately 10 degrees from the z axis measured in a direction along the y axis away from the scan axis. This orientation provides for a forward tilt or bias toward the user for increasing the ease of insertion of the ink container 12 into the ink container receiving station 14.

Figure 3:
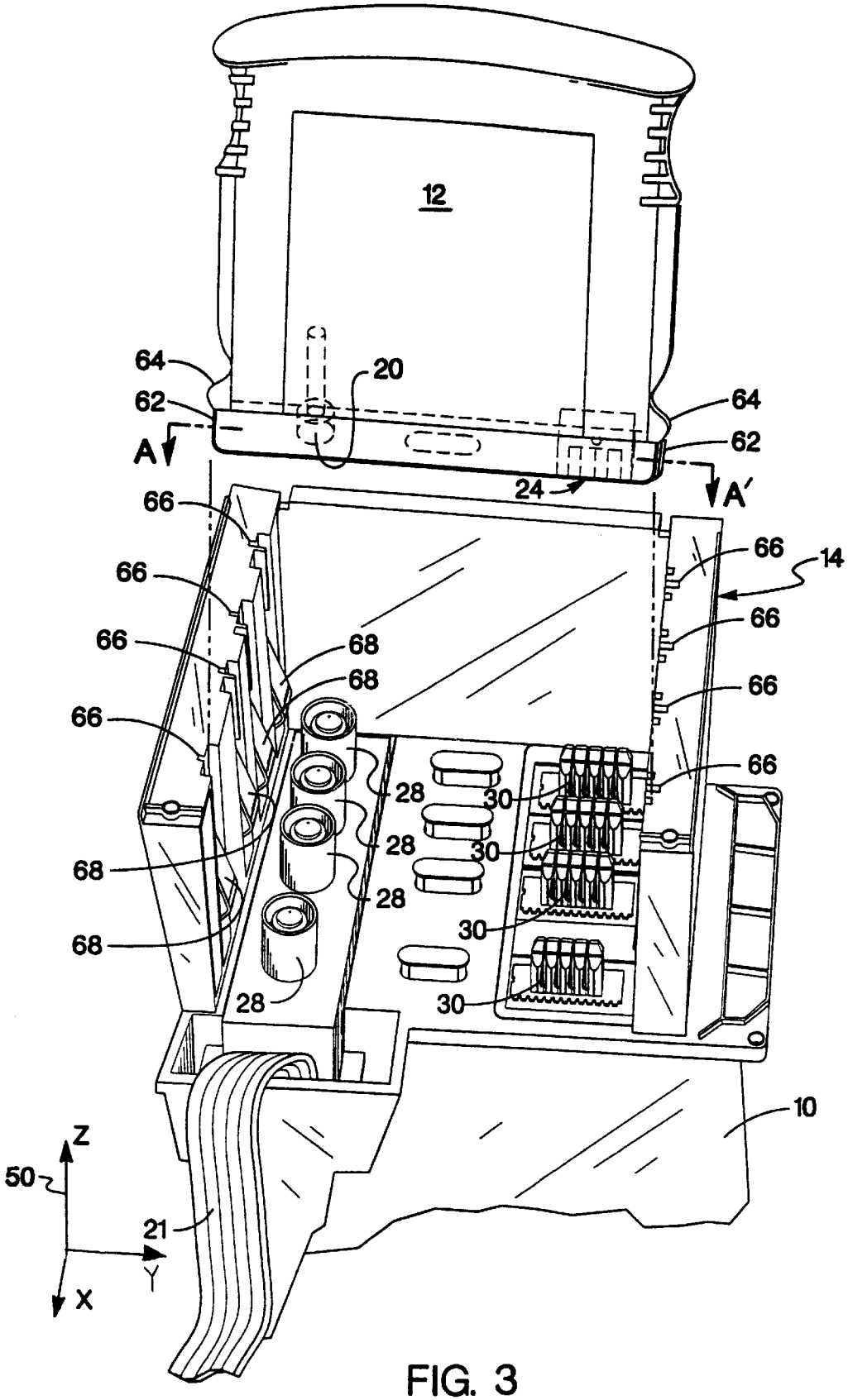
FIG. 3 is an ink supply receiving station of the type used in the printer of FIG. 2, shown broken away, with an ink container positioned for insertion into the ink supply receiving station.

FIG. 3 depicts an ink container 12 of the present invention positioned for insertion into the receiving station 14 of printer 10. The ink container 12 contains a supply of media marking fluid such as ink. Also included in the ink container 12 is the ink outlet 20, the plurality of electrical contacts 24, aligning or guiding features 62 and latching features 64 which are the subject of the present invention. The aligning features 62 on the ink container 12 are to assist in aligning the ink container 12 for insertion into the receiving station 14. The aligning features 62 work in conjunction with corresponding aligning or guiding features 66 on the receiving station 14.

The aligning features 62 are preferably positioned on opposite sides of the ink container 12. The corresponding aligning features 66 are disposed at opposite ends of the ink container receiving station 14. It is the positioning of the aligning features 62 and 66 that allow the insertion of ink containers 12 into the ink container receiving station 14 in close proximity thereby providing a compact ink container receiving station 14. The use of the aligning features 66 on opposite ends of the ink container receiving station 14 eliminates the need for partition walls between the ink containers 12 during insertion. The elimination of partition walls thereby guiding and aligning using only the aligning features 62 and 66 allows for a compact ink container receiving station 14.

These aligning features 62 and 66 in addition to providing an aligning function, also provide a keying function to ensure that the ink container 12 contains ink having the proper parameters such as proper color and is compatible with the particular printer 10. Keying and aligning features 62 and 66 are discussed in more detail in co-pending patent application Ser. No. 08/566,521 filed Dec. 4, 1995 entitled "Keying System For Ink Supply Containers" assigned to the assignee of the present invention, incorporated herein by reference.

Once the proper ink container 12 is properly aligned and inserted into the receiving station 14, a latching feature 68 engages the corresponding latching feature 64 on the ink container 12 to latch the ink container 12 into the receiving station 14. With the ink container 12 properly latched into the receiving station 14 a fluid inlet 28 associated with the receiving station 14 engages the corresponding ink outlet 20 on the ink container 12 to allow fluid to flow from the ink container 12 to the printer 10 and ultimately the printhead 16 for printing on print media.

Insertion of the ink container 12 into the receiving station 14 forms an electrical interconnect between the ink container 12 and the receiving station 14. Electrical contacts 24 associated with the ink container 12 engages corresponding electrical contacts 30 associated with the receiving station 14 to allow information to be transferred between the receiving station 14 and the ink container 12.

Figure 4:
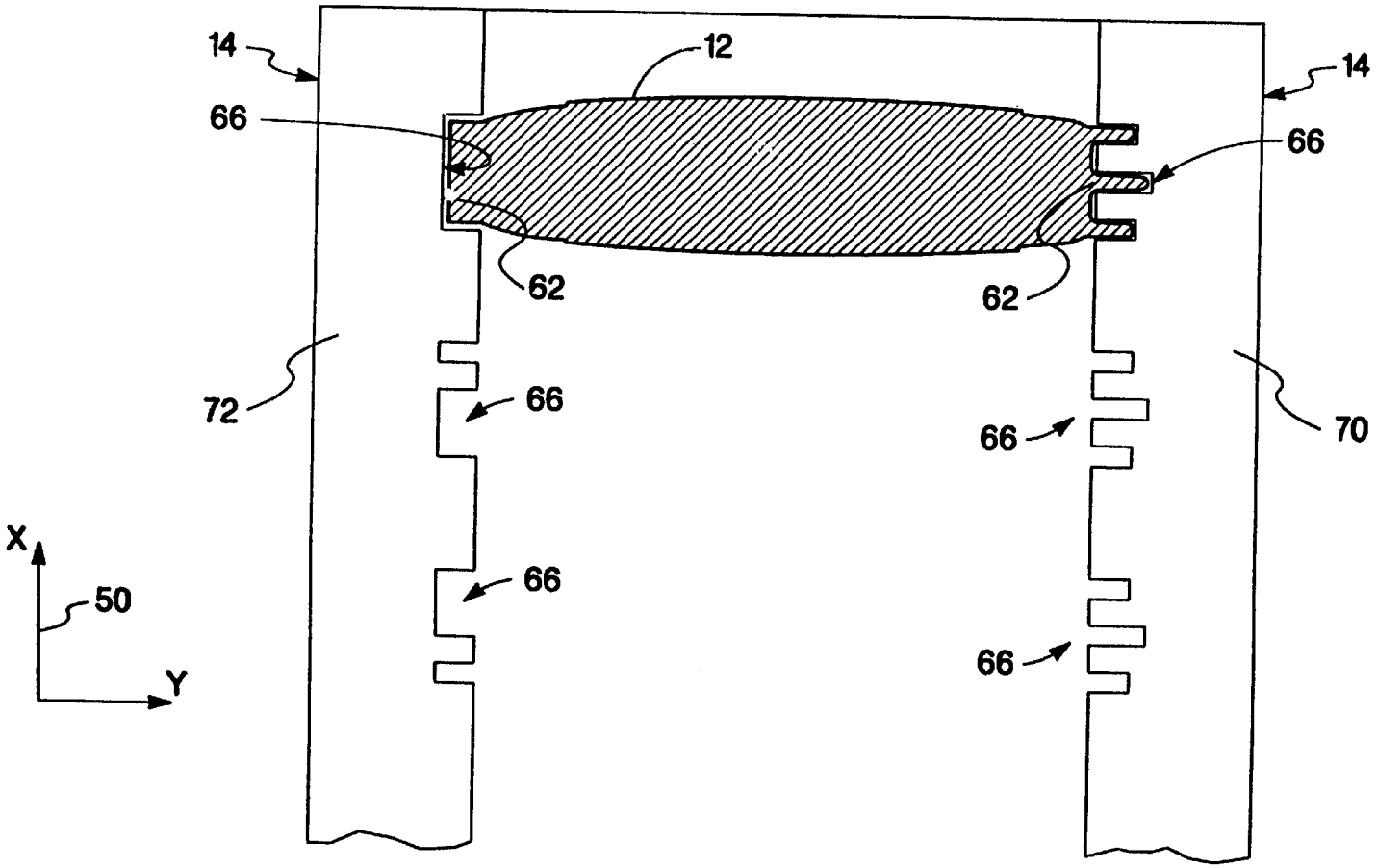
FIG. 4 depicts a simplified sectional view, partially broken away, taken across line A—A of FIG. 3 with the ink container installed in the ink container receiving station of FIG. 3.

FIG. 4 depicts a sectional view of the ink container 12 taken across the guiding features 62 of the ink container 12 with the ink container, at least partially, inserted into the receiving station 14. This figure illustrates the interaction between guiding features 62 on the ink container 12 and guiding features 66 on the container receiving station 14. The guiding features 66 are channels that extend along the insertion direction. The guiding features 66 are disposed on a first side 70 and a second side 72 of the ink container receiving station 14. The first and second sides 70 and 72 are positioned at opposite ends of the ink container receiving station 14. The guiding features 62 are disposed at opposite ends of a major axis and are configured to engage the corresponding guiding features 66 in an interlocking manner on the ink container receiving station 14. Once the ink container 12 is properly positioned such that the guiding features 62 and 66 are interlocked, then the ink containers 12 can be urged into the ink container receiving station 14 such that the ink containers 12 are slid into position so that proper fluid, electrical, and mechanical interfaces are accomplished.

The guiding features 66 are asymmetrical so that the guiding features 66 on the first side 70 are different from the guiding features 66 on the second side 72. The use of asymmetrical guiding features 66 between the two sides 70 and 72 prevents the ink containers 12 from being improperly inserted in an orientation 180 degrees from the proper orientation along the y axis. Additionally, the use of asymmetric guiding features 62 and 66 provides a visual guide to the user to help ensure proper insertion of the ink containers 12. By preventing the ink containers 12 from being installed such that the aligning features 66 associated with the first side 70 are improperly inserted into the second side 72, damage to the printer 10 is avoided and printer 10 reliability is enhanced.

Figure 5:
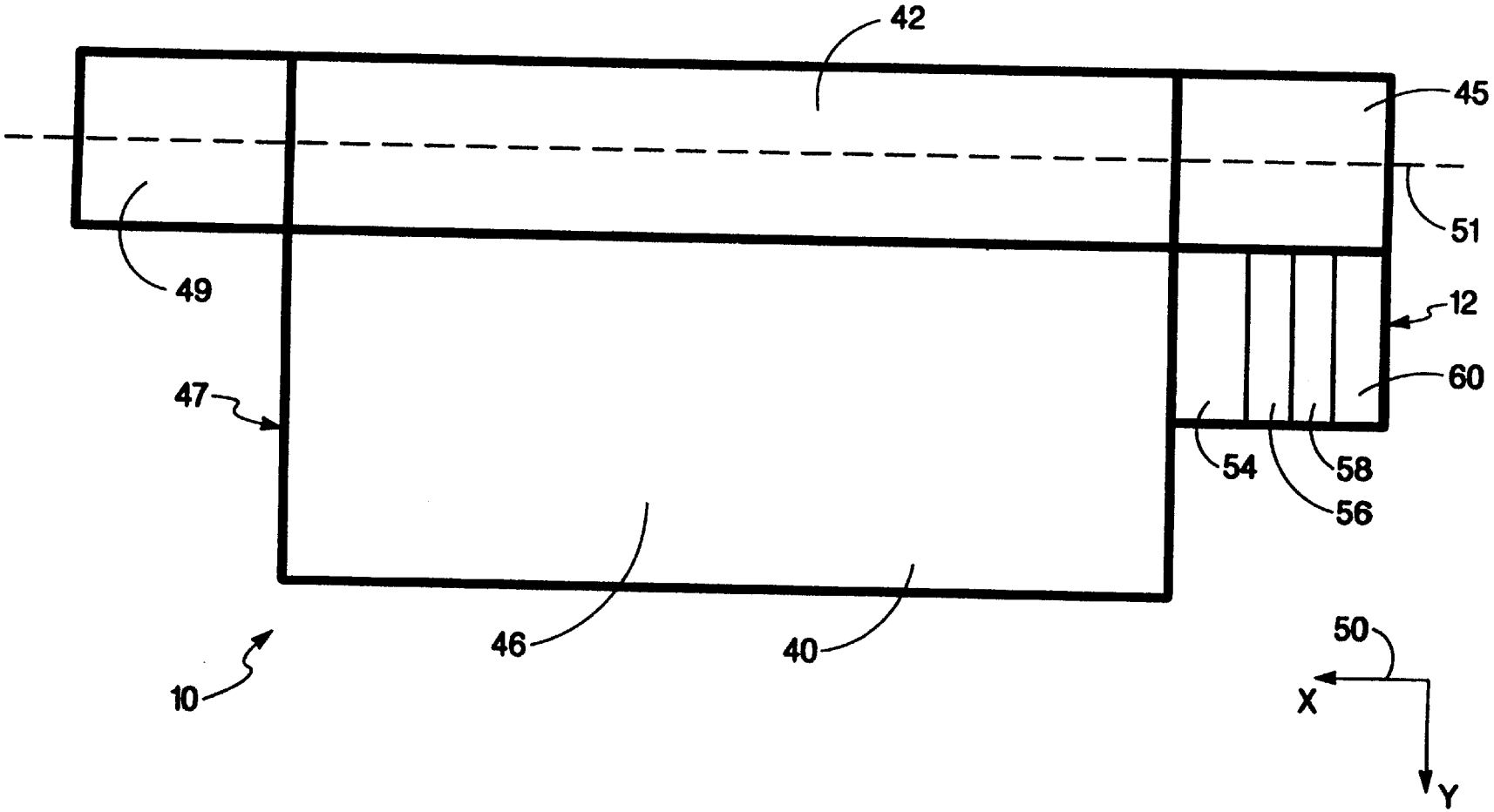
FIG. 5 is a schematic representation of a top plan view of the printer shown in FIG. 2.

FIG. 5 depicts a schematic representation of a top plan view of the printer 10 shown in FIG. 2. This representation is intended only to show general printer 10 layout features and is not intended to be an accurate or proportional representation of the printer 10 layout. The printer 10 includes a media transport portion 47, the print zone portion 42, the service station 45, ink containers 12 and an overtravel portion 49. The media transport portion 47 includes the paper tray 40 and the output tray 46 which are positioned forward from the print zone 42. Adjacent the print zone 42, along the scan axis 51 as represented by the x axis in coordinate system 50, is the service station 45. The service station 45 in one preferred embodiment is disposed to the right of the print zone 42 from the perspective of one facing the front of the printer 10. Adjacent the print zone 42, opposite the service station 45 and along the scan axis 51 is the overtravel portion 49.

The overtravel portion 49 results from the overtravel of the scanning carriage 44 to either side of the printzone 42. This overtravel results from the positioning of printheads 16 at either edge of the print media. Each of the plurality of printheads 16 are arranged along the scan axis 51 within the carriage 44. Therefore, to position individual nozzles associated with each of the plurality of printheads 16 at either edge of the print media, the print carriage 44 must overtravel or extend beyond the print media on either side of the printzone 42. The width of this overtravel portion 49 at the left side of the printer 10 is equal to the distance a furthest right printhead nozzle is spaced from the left edge of the carriage 44. Similarly, overtravel at the right side of the printer 10 is equal to the distance a furthest left printhead nozzle is spaced from the right edge of the carriage 44.

In the embodiment depicted in FIG. 5 the ink containers 12 are arranged forward of the service station 45. In this preferred embodiment each of the ink containers 54, 56, 58, and 60 are arranged in a side by side arrangement along a line parallel to the scan axis 51. It is the use of the aligning features 62 and 66 on the ink containers 12 and supply station 14, respectively, that allows the ink containers 12 to be positioned in this closely spaced side by side arrangement. The placement of the aligning features 62 only on the major axis of the ink container 12 allows the ink containers 12 to be placed in a closely spaced relationship along a minor axis. The use of aligning feature 62 on the minor axis (x axis) increases the supply station 14 width along the x axis. Therefore, this arrangement of aligning features 62 and 66 allow the ink containers 12 to fit in a compact supply station 14 disposed in the region forward of the service station 45. This compact supply station 14 includes aligning features 62 and 66 to aid in the guiding and insertion of the ink containers 12 into the supply station 14.

Each of the individual ink containers 54, 56, 58 and 60 are configured to have a width in the direction of the scan axis 51 (x axis), a length in the direction orthogonal to the width and a height orthogonal to both the length and the width. The ink containers 54, 56, 58 and 60 can all have identical widths as shown in FIG. 2 or one or more of these ink containers 54, 56, 58 and 60 can have larger or smaller widths depending on the volume of the ink container desired. For example, in the case of the four color printer 10 shown in FIG. 2, if black ink which is provided to the printhead 16 by ink container 54 is consumed faster than the yellow, magenta ink, and cyan ink provided by ink containers 56, 58, and 60, respectively, then a larger ink container (not shown) can be substituted for the ink container 54. This larger ink container for black ink is provided as a convenience to the user to reduce a frequency of ink container replacement.

The ink containers 54, 56, 58 and 60 are in a spaced relationship that is generally parallel to the scan axis 51 to allow users to see each ink container 12 as well as provide easy access to each container 12 for replacing the container 12. In addition, the service station 45 is positioned to the right side of the printzone 42 because the service station 45 has a width, along the scan axis 51, that is typically larger than a width, along the scan axis 51, associated with the overtravel portion 49. The carriage 44 typically has overtravel to the right side of the print zone 42 for the same reason the carriage overtravel portion 49 to the left side of the print zone 42. However, the service station 45 tends to have a greater width in the scan axis 51 than the overtravel portion 49 because the carriage 44 is typically moved completely out of the print zone 42 for printhead servicing.

Positioning the ink containers on the right side of the print zone 42 provides greater ease of access to the ink containers 12 by right handed users which are the predominant users. Furthermore, positioning the ink containers on the right and forward of the service station 45 allows more room for positioning the ink containers 12 without adding to the printer 10 overall width in a direction parallel to the scan axis 51.

Figure 6B:
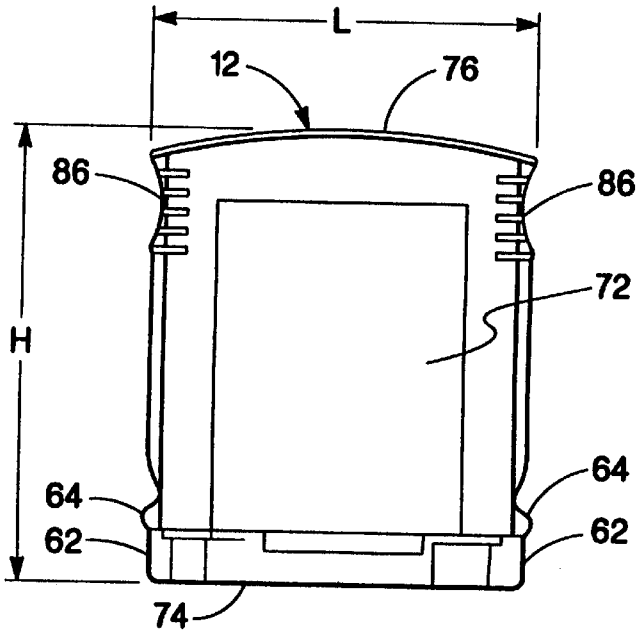
FIGS. 6*a*, 6*b*, and 6*c* depict an isometric view of one preferred embodiment of the ink container of the present invention.
Figure 6C:
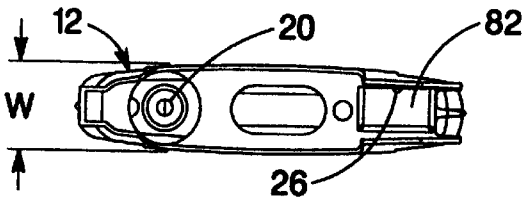
Figure 6A:
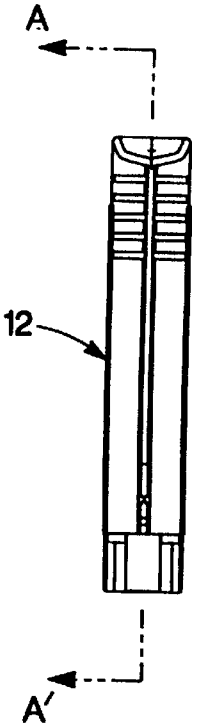

FIGS. 6*a*, 6*b*, and 6*c* depicts isometric views of one preferred ink container 12 of the present invention. The ink container 12 includes an outer surface or housing 72 having a leading edge 74 and a trailing edge 76 relative to the direction of insertion of the ink container 12 into the receiving station 14.

The outer surface 72 defines an opening 82 into a cavity at the leading edge 72 of the ink container 12 shown in FIG. 6*c*. A storage device 26 having a plurality of electrical contacts 24 (shown in FIG. 1) associated therewith are mounted within the cavity. The electrical contacts 24 are configured to engage corresponding electrical contacts 30 associated with the receiving station 14 when the ink container 12 is properly inserted into the printer 10.

Also disposed on the leading edge 74 is the fluid outlet 20. The fluid outlet 20 is configured to engage the corresponding fluid inlet 28 on the supply station 14 to form a fluid interconnect between the ink container 12 and the printer 10. The insertion of the ink containers 12 in a vertical direction, along the z axis, with the fluid outlet 20 on the leading edge 74 allows air to rise to the top of the ink containers 12 toward the trailing edge 76. This orientation of the ink containers 12 during use tends to prevent air within the ink containers 12 from being transferred to the supply station 14 and ultimately the printhead 16. Air ingestion by the printhead 16 can result in poor print quality and reduce reliability of the printhead 16.

Aligning features 62 and latching features 64 are provided on the ink container 12. The aligning features 62 aid in the insertion of the ink container 12 into the receiving station 14. The aligning features 62 are preferably disposed adjacent the leading edge 74 of the ink container 12. Having aligning features 62 adjacent to the leading edge 74 assures proper alignment of the ink container 12 early in the insertion process. Stated another way, the user gets immediate feedback (before partial insertion) if he or she tries to insert the ink container 12 in the wrong position and/or orientation. Additionally, the user can visually align leading edge features on the ink container 12 to leading edge features on the receiving station 14. Proper positioning would be much more difficult if such features were recessed away from the leading edge 74. By positioning the aligning features 62 adjacent the leading edge 74 allows alignment of the ink containers 12 early in the insertion process. Once the ink container 12 is inserted into the receiving station 14, the latching features 64 engage the spring 68 to secure the ink container 12 into the receiving station 14. (see FIG. 3)

As stated earlier, the electrical and fluidic interconnects are disposed on the leading edge of the ink container 12. Positioning of the aligning features 62 close to the leading edge 74 places them close to the features requiring critical alignment. In order for supply station and ink container parts to be low cost, they tend to be molded without extremely tight tolerances. Thus, the engagement features 62 on the ink container 12 is slightly smaller than the engagement features 66 on the receiving station 14 (see FIG. 4) with the size difference roughly proportional to the expected molding variations. As a result, there is some placement variation between the respective features that engage. The farther these features are from the fluid and electrical interconnects, the more effect angular variations in the supply insertion will affect placement between the electrical and fluidic interconnects on the ink container 12 and the respective interconnects in the receiving station 14. Minimizing this distance minimizes such critical placement variation.

Gripping feature 86 is provided toward the trailing edge 76 at opposite ends of the ink container 12. The gripping feature 86 is a contoured gripping surface that is shaped and textured to allow a user to easily grip the ink containers 12 between thumb and forefinger. The gripping feature 86 is larger at the trailing edge 76 providing an overhang which facilitates gripping the ink containers 12 during extraction of the ink containers 12 from the supply station 14. The overhang portion is in the length direction, along the y axis, which allows the ink containers 12 to be closely spaced in the width direction, along the x axis.

The enlarged trailing edge 76 in addition to facilitating gripping the containers 12, also prevents inadvertent upside-down insertion of the ink containers 12 into the supply station 14. The enlarged trailing edge 76 provides a visual guide to the user regarding proper orientation of the ink containers 12 during insertion into the printer 10. Additionally, the enlarged trailing edge 76 prevents printer 10 failure resulting from insertion of the ink containers 12 into the supply station 14, trailing edge 76 first.

The ink container 12 has a height and length associated therewith designated by letters H and L, respectively, in FIG. 6*b*. The length, L, is in a direction generally orthogonal to the scan axis 51 and the height, H, is in a direction generally orthogonal to both the scan axis 51 and the length, L. The ink container 12 has a width associated therewith designated by the letter W in FIG. 6*c*. The width, w, is in a direction generally parallel to the scan axis 51.

The width, W, of the ink container 12 is selected to be less than a width associated the service station 45 minus the widths, W, of the remaining ink containers 12. For example, if all of the ink containers 12 have the same width, W, then the width of each ink container 12 is less than the width associated with the service station 45 divided by the number of ink containers 12. Therefore, the ink containers 12 have a width, W, associated with each container to allow all of the ink containers 12 to be arranged side by side, in a width direction, such that a combined widths of each of the ink containers 12 is less than the width associated with the service station 45. The sizing of the widths for the ink containers 12 are based on the width of the service station 45 for maintaining a relatively small overall width along the scan axis 51 for the printer 10. In the preferred embodiment depicted in FIGS. 6*a*, 6*b*, and 6*c* the width, W, of the ink container 12 is approximately 15 millimeters (mm).

The length, L, of the ink container 12 is selected based on human ergonomics or an ability of a user to grasp the ink container 12. In the preferred embodiment the length, L, of the ink container 12 is selected such that a majority of users can grasp the ink container 12 between thumb and forefinger across the length, L, of the ink container 12. In this preferred embodiment the length, L, is selected to conform to the grasping width or anthropometric limit, for grasping using thumb and forefinger for the 5 percentile female user. Therefore, 95 percent of the female users are capable of grasping the ink container 12 using thumb and forefinger to grasp the ink container 12 in the length direction. In this preferred embodiment the ink container 12 has a length that is approximately 70 millimeters.

The height, H, of the ink container 12 is selected based on a tradeoff between convenience to the user and ensuring maximum print quality. The ink container 12 should be large to minimize the frequency of replacement and should be small enough such that the ink container 12 is exhausted before aging effects such as VTR loss which tends to reduce print quality. In one preferred embodiment the ink container 12 is selected to have a height of 85 millimeters which allows at least one ink container 12 to have a volume of 80 cubic centimeters (cc) of ink and 3 ink containers 12 to have a volume of 30 cubic centimeters (cc) of ink. A high volume user will typically consume 80 cc's of black ink and 30 cc's of color ink in a range of 2 to 6 months. Sizing the ink container 12 such that ink is consumed prior to 6 months helps assure maximum print quality. Finally, the height, H, should be selected so that an overall height of the printer 10 is kept small thereby tending to minimize the printer 10 overall size.

Figure 7B:
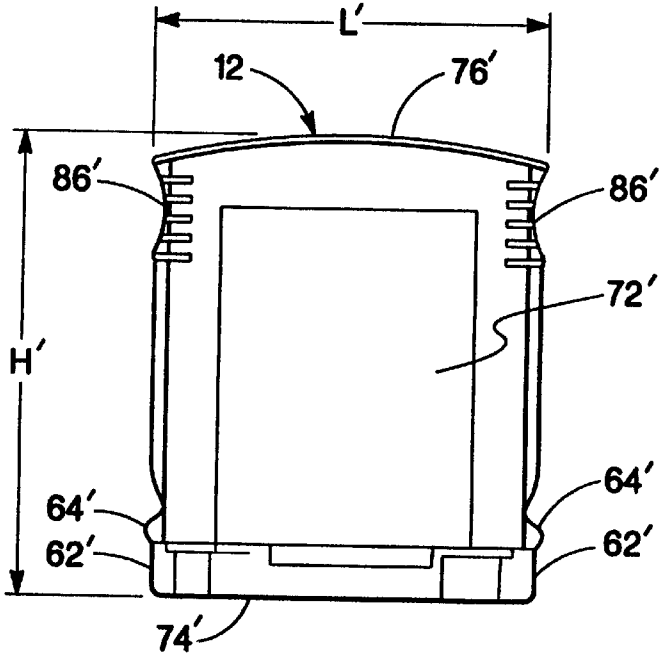
FIGS. 7*a*, 7*b*, and 7*c* depict an isometric view of an alternate embodiment of the ink container of the present invention.
Figure 7C:
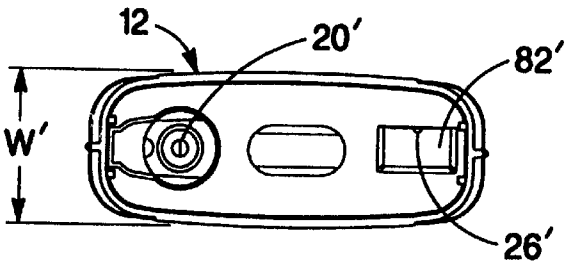
Figure 7A:
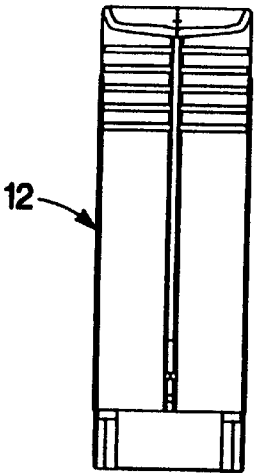

FIGS. 7*a*, 7*b*, and 7*c* depicts isometric views of another preferred embodiment of the ink container 12 of the present invention. The ink container 12 is similar to the ink container depicted in FIGS. 6*a*, 6*b*, and 6*c* except that the ink container in FIGS. 7*a*, 7*b*, and 7*c* has a greater width, W, allowing the ink container 12 to contain greater volumes of ink. Similar numbering and lettering in FIGS. 7*a*, 7*b*, and 7*c* is used to identify structures that are similar to structures depicted in FIGS. 6*a*, 6*b*, and 6*c*.

The ink container 12 has a height and length associated therewith designated by letters H' and L', respectively, in FIG. 7*b*. The length, L', is in a direction generally orthogonal to the scan axis 51 and the height, H', is in a direction generally orthogonal to both the scan axis 51 and the length, L'. The ink container 12 has a width associated therewith designated by the letter W' in FIG. 7*c*. The width, W', is in a direction generally parallel to the scan axis 51.

In one preferred embodiment the ink container 12 is selected to have a height, H', of 85 millimeters, a width, W', which is approximately 32 millimeters (mm) and a length of approximately 73 millimeters. This preferred ink container 12 has a volume of 80 cubic centimeters (cc). A cavity 82' is defined in an outer surface 72' similar to the ink container 12 shown in FIGS. 6*a*, 6*b*, and 6*c*. Both the cavity 82' having storage device 26' and fluid outlet 20' are positioned in an identical position relative to aligning features 62' thereby allowing either the small 30 cc or the large 80 cc ink container 12 to be inserted into the same slot. By allowing at least one slot in the service station 45 to receive ink container 12 of varying widths provides greater convenience for the user. For example, if the printer application uses one color at a faster rate than the other colors, then the user can use a larger volume ink container 12 thereby reducing the frequency of replacement. Typically, black ink is used at a higher rate and therefore, the black ink container 12 slot is spaced to accommodate varying width ink containers 12.

The present invention provides an ink container 12 that includes guiding features 62 that together with the guiding features 66 guide the ink containers 12 into the supply station 14 to provide a reliable electrical, mechanical, and fluidic interconnect between the ink container 12 and the ink container receiving station 14. The guiding features 62 and 66 are disposed and arranged to allow the ink containers 12 to fit in a closely spaced side by side arrangement within the receiving station 14. The sizing of the ink containers 12 and service station within a space at least partially defined by the service station 45 tends to maintain a small overall width for the printer 10. In addition, the positioning of the ink containers 12 in an arrangement that is parallel to the scan axis 51 and positioned in front of the service station 45 and to the right of the paper trays 40 and 46 ensure easy access for changing the ink containers 12. Finally, the orientation of the ink containers 12 in a generally vertical orientation with the fluid and electrical interconnect on the leading edge 74 provides an arrangement that is convenient and allows for ease of insertion and removal of the ink containers 12.

What is claimed is:

1. A replaceable ink container for use in a printing system, the printing system having a printhead mounted in a scanning carriage and a supply station for receiving the replaceable ink container, the supply station being in fluid communication with the printhead, the replaceable ink container comprising:

a fluid outlet configured for engaging a corresponding fluid inlet portion on the supply station; and first and second guide features disposed on opposite sides of an outer surface of the replaceable ink container with the first and second guide features disposed and arranged to engage corresponding first and second guiding features disposed on opposite ends of the supply station, the corresponding first and second guiding features guiding the replaceable ink container into the supply station upon non-rotatable insertional movement of the replaceable ink container into the supply station to fluidically couple the fluid outlet to the corresponding fluid inlet portion.

2. The replaceable ink container of claim 1 wherein the opposite ends of the supply station are first and second ends that define a compartment with the first and second ends including the corresponding first and second guiding features, respectively, for guiding the replaceable ink container into the supply station.

3. The replaceable ink container of claim 2 wherein the corresponding first and second guiding features of the supply station are at least one channel defined in each of the first and second ends of the supply station with each channel having a channel orientation along a direction of insertion of the replaceable ink container into the supply station.

4. The replaceable ink container of claim 1 wherein the first and second guide features of the replaceable ink container are first and second projection members that extend from the outer surface of the replaceable ink container, and wherein the first and second projection members engage the corresponding first and second guiding features so as to limit movement of the replaceable ink container to a non-rotatable, linear sliding motion along a direction of insertion of the replaceable ink container into the supply station.

5. The replaceable ink container of claim 1 wherein the replaceable ink container has a leading edge defined as that edge of the replaceable ink container first received by the supply station upon insertion of the replaceable ink container into the supply station, and wherein the fluid outlet is disposed on the leading edge.

6. The replaceable ink container of claim 1 wherein only the first and second guide features of the replaceable ink container engage the supply station to guide the replaceable ink container into the supply station to fluidically couple the fluid outlet to the corresponding fluid inlet portion.

7. The replaceable ink container of claim 1 wherein the replaceable ink container is inserted into the supply station along an insertion direction that is vertical.

8. The replaceable ink container of claim 1 wherein the replaceable ink container has a minor axis and a major axis oriented orthogonal to a direction of insertion of the replaceable ink container into the supply station, and wherein the first and second guide features are disposed on the major axis.

9. The replaceable ink container of claim 1 wherein a shape defining the first guide feature is unlike a shape defining the second guide feature.

10. A printing system having a printhead mounted in a scanning carriage, the printing system including a plurality of replaceable ink containers and a supply station for receiving the plurality of replaceable ink containers, the supply station being in fluid communication with the printhead, the printing system comprising:

a supply station in fluid communication with the printhead, the supply station having a plurality of fluid inlets and a plurality of pairs of guiding features disposed on opposite sides of the supply station; and a plurality of replaceable ink containers with each ink container including a fluid outlet configured for engaging a corresponding fluid inlet of the plurality of fluid inlets on the supply station, and a pair of guide features disposed on opposite sides of each ink container, the pair of guide features of each ink container being configured to engage a corresponding pair of guiding features of the plurality of pairs of guiding features on the supply station to guide each ink container of the plurality of replaceable ink containers into the supply station upon non-rotatable insertional movement of each ink container into the supply station to fluidically couple the fluid outlets and the corresponding fluid inlets.

11. The printing system of claim 10 wherein only the plurality of pairs of guiding features of the supply station define spacings between adjacent ink containers of the plurality of replaceable ink containers.

12. A method for inserting an ink container into a printer having a printhead mounted in a scanning cartridge, the printer including a supply station in fluid communication with the printhead, the method comprising the steps of:

positioning a first ink container into the supply station so that first and second guide features disposed on opposite sides of an outer surface of the first ink container engage first and second guiding features, respectively, disposed on opposite ends of the supply station;

inserting the first ink container into the supply station using non-rotatable movement of the first ink container such that the first and second guiding features on the supply station together with the first and second guide features of the first ink container guide the first ink container into the supply station to position an ink outlet of the first ink container into engagement with an ink inlet of the supply station to fluidically couple the first ink container and the supply station.

13. The method for inserting an ink container into a printer of claim 12 further including providing ink from the first ink container to the printhead.

14. The method for inserting an ink container into a printer of claim 13 further including after providing ink to the printhead, refilling the first ink container.

15. The method for inserting an ink container into a printer of claim 12 further including positioning a second ink container into the supply station immediately adjacent the first ink container so that third and fourth guide features disposed on opposite sides of an outer surface of the second ink container engage third and fourth guiding features, respectively, disposed on the opposite ends of the supply station adjacent to the first and second guiding features, respectively.

* * * * *